US010109955B2

(12) United States Patent
Holub et al.

(10) Patent No.: US 10,109,955 B2
(45) Date of Patent: Oct. 23, 2018

(54) ELECTRICAL CONNECTOR APPARATUS HAVING A MALE HOUSING AND A FEMALE HOUSING WITH RIBS

(71) Applicant: J.S.T. Corporation, Farmington Hills, MI (US)

(72) Inventors: Franklin A. Holub, West Bloomfield, MI (US); Rajit Abraham, Shelby Township, MI (US); Khalid Jabrane, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/405,654

(22) Filed: Jan. 13, 2017

(65) Prior Publication Data

US 2017/0207577 A1 Jul. 20, 2017

Related U.S. Application Data

(60) Provisional application No. 62/278,642, filed on Jan. 14, 2016.

(51) Int. Cl.
*H01R 13/514* (2006.01)
*H01R 13/64* (2006.01)
(Continued)

(52) U.S. Cl.
CPC ..... *H01R 13/64* (2013.01); *H01R 13/4361* (2013.01); *H01R 43/20* (2013.01); *H01R 13/4362* (2013.01)

(58) Field of Classification Search
CPC ..... H01R 13/4362
(Continued)

(56) References Cited

U.S. PATENT DOCUMENTS 4,946,398 A 8/1990 Takenouchi
5,004,436 A 4/1991 Aoyama
(Continued)

FOREIGN PATENT DOCUMENTS

EP 0828318 A2 3/1998
EP 3046185 A 7/2016
GB 2255864 A 11/1992

OTHER PUBLICATIONS

USPTO Office Action in U.S. Appl. No. 15/407,562, dated Jun. 9, 2017.

(Continued)

*Primary Examiner* — Tho D Ta
(74) *Attorney, Agent, or Firm* — Kratz, Quintos & Hanson, LLP

(57) ABSTRACT

An electrical connector apparatus with a protected terminal position assurance device (TPA) provided in the male housing and the female housing, the male housing having a TPA for connecting thereto at least a set of terminals, and the female housing having a TPA for connecting thereto at least a set of terminals. Specifically, the male housing and the female housing of the electrical connector apparatus are designed with ribs and other protective features to prevent the TPA from moving from a pre-set position to a final lock position during shipping and/or handling. The ribs and other protective features of the male housing and the female housing ensure a physical barrier from any contact with the TPA which may alter the position of the TPA.

12 Claims, 11 Drawing Sheets

(51) Int. Cl.
*H01R 43/20* (2006.01)
*H01R 13/436* (2006.01)

(58) Field of Classification Search
USPC ..... 439/489, 752
See application file for complete search history.

(56) References Cited

U.S. PATENT DOCUMENTS 5,145,419 A 9/1992 Yamanashi
5,224,883 A 7/1993 Yamamoto
5,252,096 A 10/1993 Okada
5,358,427 A 10/1994 Miwa
5,507,666 A 4/1996 Yamanashi
5,516,308 A * 5/1996 Yamanashi ..... H01R 13/4362 439/752
5,782,657 A 7/1998 Wolla
5,830,013 A * 11/1998 Saito ..... H01R 13/4362 439/595
5,839,915 A 11/1998 Ford
5,928,038 A 7/1999 Berg
5,934,946 A * 8/1999 Nakamura ..... H01R 13/4362 439/489
6,010,374 A 1/2000 Miwa
6,036,552 A 3/2000 Atsumi
6,068,507 A 5/2000 Popa
6,135,802 A 10/2000 Nakamura
6,171,150 B1 1/2001 Saito
6,261,116 B1 7/2001 Ceru
6,296,531 B1 * 10/2001 Nagamine ..... H01R 13/4362 439/595
6,390,859 B2 5/2002 Furutani
6,464,544 B1 10/2002 Yamamoto
6,527,583 B2 * 3/2003 Plate ..... H01R 13/4362 439/157
6,648,699 B1 11/2003 Makino
6,655,999 B2 12/2003 Mase
6,702,626 B2 * 3/2004 Ichio ..... H01R 13/4362 439/752
6,780,045 B2 8/2004 Shuey
6,902,443 B2 6/2005 Hara
7,114,992 B2 10/2006 Sagawa
7,182,652 B2 * 2/2007 Yamakado ..... H01R 13/4362 439/752
7,195,522 B2 3/2007 Okada
7,278,890 B1 * 10/2007 Smutny ..... H01R 13/4361 439/752
7,347,745 B1 3/2008 Raudenbush
7,500,887 B2 3/2009 Ichio
7,544,081 B2 6/2009 Lim
7,556,539 B2 7/2009 Takahashi
8,075,351 B2 12/2011 Park
8,096,841 B2 1/2012 Hirano
8,277,243 B1 10/2012 Hernandez
8,641,458 B2 * 2/2014 Matsumura ..... H01R 13/4223 439/595
8,747,146 B2 6/2014 Brown
8,951,066 B2 2/2015 Glick
9,017,108 B2 4/2015 Suemitsu
9,039,462 B2 5/2015 Yoon
9,048,563 B2 6/2015 Miura
9,160,095 B2 10/2015 Littek
9,318,847 B2 4/2016 Endo
2017/0179643 A1 6/2017 Golub
2017/0207575 A1 7/2017 Jabrane
2017/0207578 A1 7/2017 Abraham
2017/0207594 A1 7/2017 Jabrane

OTHER PUBLICATIONS

USPTO Office Action in U.S. Appl. No. 15/407,562, dated Oct. 20, 2017.
European Search Report in European Application Serial No. 17207724.0, dated Mar. 29, 2018.
European Search Report in European Application Serial No. 17207725.7, dated Mar. 29, 2018.
European Search Report in European Application Serial No. 17207739.8, dated Mar. 29, 2018.
European Search Report in European Application Serial No. 17207747.1, dated Mar. 29, 2018.
U.S. PTO Office Action in U.S. Appl. No. 15/405,405, dated Jan. 8, 2018.
U.S. PTO Office Action in U.S. Appl. No. 15/405,405, dated Jul. 26, 2017.
U.S. PTO Office Action in U.S. Appl. No. 15/405,405, dated May 16, 2017.
USPTO Office Action in U.S. Appl. No. 15/407,562, dated Mar. 8, 2018.

* cited by examiner

ELECTRICAL CONNECTOR APPARATUS HAVING A MALE HOUSING AND A FEMALE HOUSING WITH RIBS

BACKGROUND OF THE INVENTION

The present invention generally relates to an electrical connector apparatus with a male housing and a female housing having a terminal position assurance device (TPA). More particularly, the invention is directed to ribs and other protective features provided on the male housing and the female housing to prevent the TPA from moving from a pre-set position to a final lock position.

SUMMARY OF THE INVENTION

The present invention generally relates to an electrical connector apparatus having a male housing and a female housing, the male housing having a terminal position assurance device (TPA) for connecting thereto at least a set of terminals, and the female housing having a terminal position assurance device (TPA) for connecting thereto at least a set of terminals.

At least a terminal is provided into each of the male housing and the female housing, when each of their respective TPA is at a pre-set position. The set of terminals provided for the male housing is secured thereto when the TPA thereof is placed at the final lock position. Similarly, the set of terminals provided for the female housing is secured thereto when the TPA of the female housing is placed at the final lock position. Thereafter, the male housing and the female housing may be engaged together.

To ensure that the TPA provided in the male housing and the TPA provided in the female housing of the electrical connector apparatus is not moved from a pre-set position to a final lock position during shipping and/or handling, the male housing and the female housing are provided with ribs to protect the TPA from physical contact. These ribs create a physical protective barrier to prevent the TPA from being moved from the pre-set position to the final lock position.

The electrical connector apparatus of the present invention is assembled and packaged in bags in bulk and shipped with the TPA in the pre-set position. This way, the operator can insert terminals into the electrical connector apparatus immediately upon receiving the electrical connector apparatus.

However, since the electrical connector apparatus is packaged and shipped in bulk, various parts can make contact with the TPA during shipping and/or handling which can cause an unprotected TPA from being moved from the pre-set position to the final lock position. If this occurs, the operator of the electrical connector apparatus will have to reset the TPA from the final position to the pre-set position in order to insert the terminals. This causes an inconvenience to the operator as well as wastes time when inserting the terminals into the electrical connector apparatus.

Additional features, advantages, and embodiments of the invention are set forth apparent from consideration of the following detailed description, drawings, and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1:
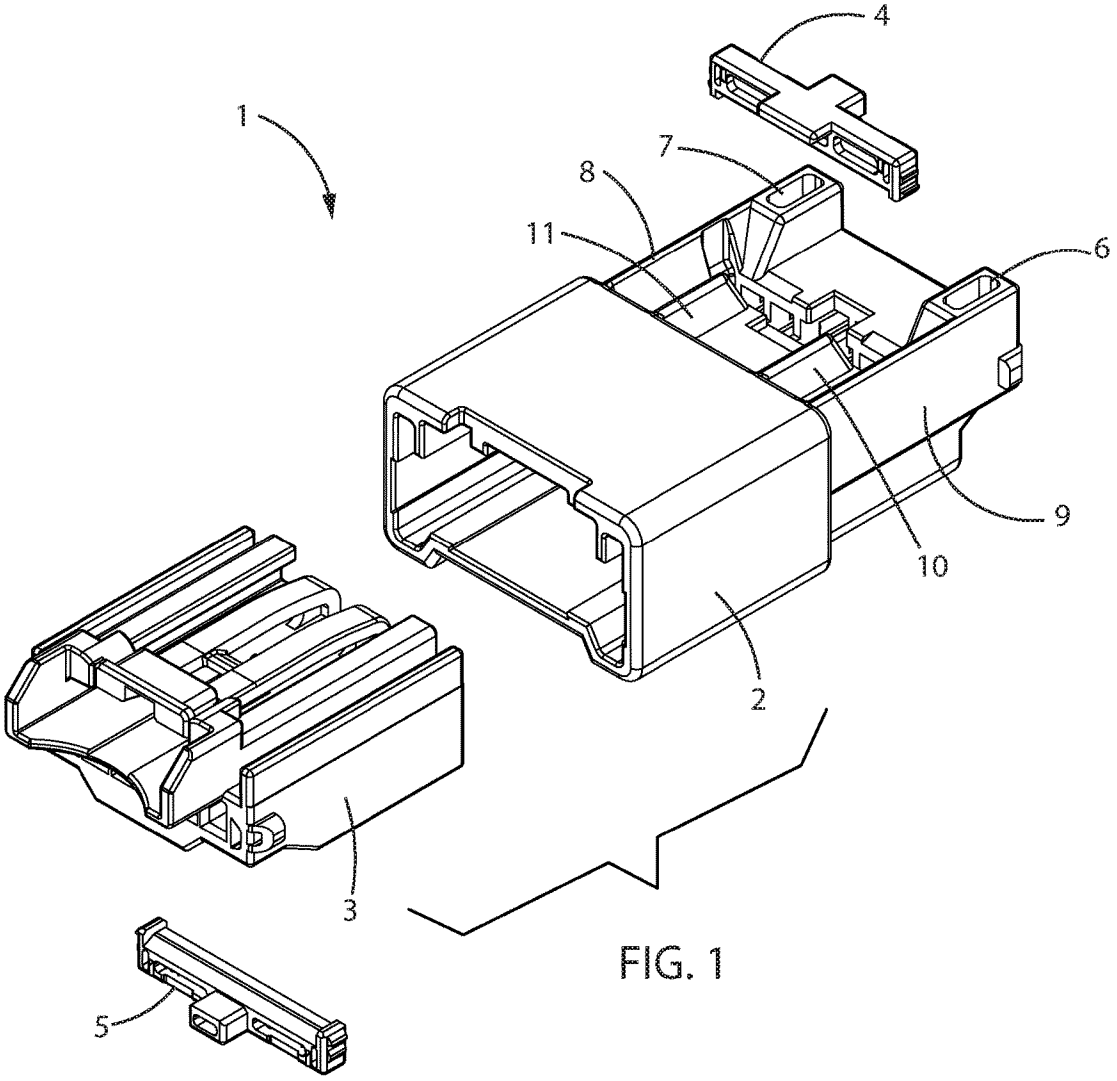
FIG. 1 is an exploded perspective view of the electrical connector apparatus of the present invention including the male housing, the female housing, and the TPA.

FIG. 1 is an exploded view showing the electrical connector apparatus of the present invention, generally referred to as reference number 1. The electrical connector apparatus 1 includes a male housing 2 and a female housing 3. TPA 4 is provided in the male housing 2 and TPA 5 is provided in the female housing 3. Additionally, FIG. 1 shows ribs 6, 7, 8, 9, 10, and 11 of the male housing 2.

Ribs 6, 7, 8, 9, 10, and 11 are provided on the male housing 2 in order to protect the TPA 4 from any physical contact. Therefore, when the TPA 4 is set in the pre-set position during shipping, the ribs 6, 7, 8, 9, 10, and 11 will prevent the TPA 4 from moving to the final lock position. Furthermore, the ribs 6, 7, 8, 9, 10, and 11 are located on the periphery of the TPA 4 so as to protect the TPA 4 from all sides.

Furthermore, as can be seen in FIG. 1, the male housing has a set of terminal apertures for receiving therein a set of other terminals. The male housing also comprises an opening for receiving the female housing.

Figure 2A:
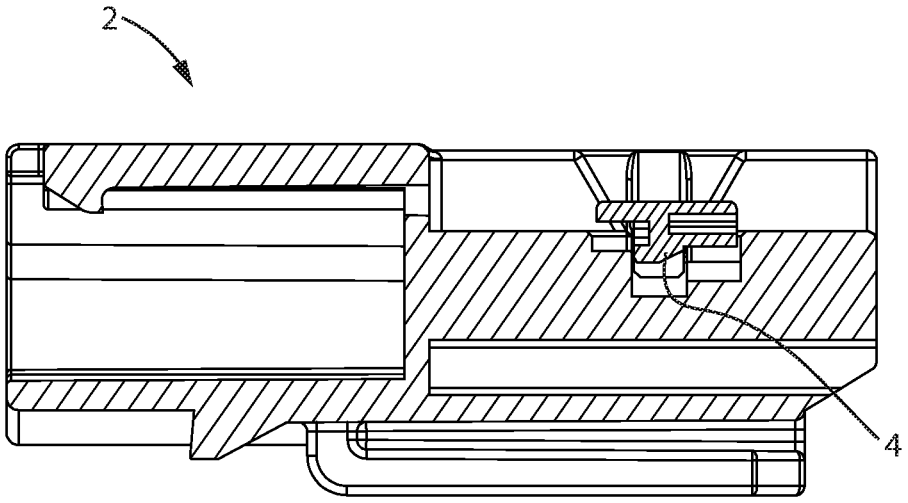
FIG. 2A is a cross-sectional view of the first embodiment of the present invention showing the male housing of the electrical connector apparatus with the TPA in the pre-set position.
Figure 2B:
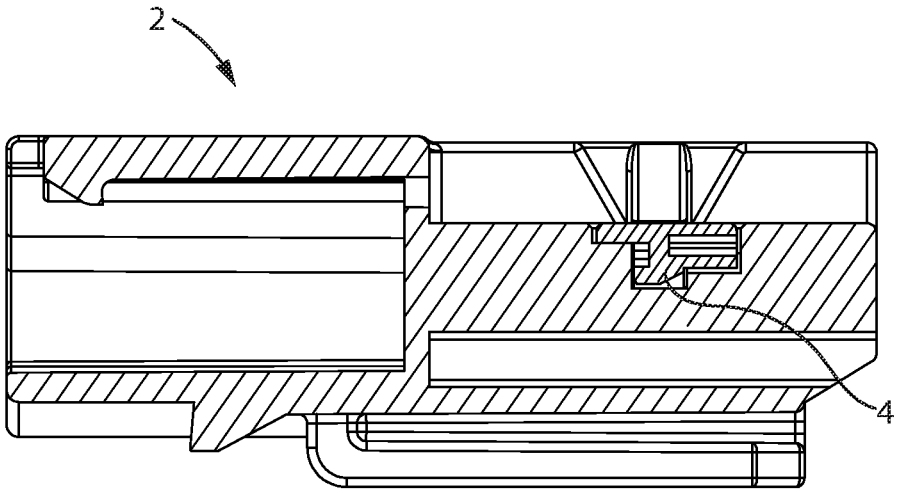
FIG. 2B is a cross-sectional view of the first embodiment of the present invention showing the male housing of the electrical connector apparatus with the TPA in the final lock position.

FIG. 2A depicts a cross-sectional view of the male housing 2 in which the TPA 4 is in the pre-set position. This is the position in which the male housing 2 of the electrical connector apparatus 1 is shipped. FIG. 2B shows a cross-sectional view of the male housing 2 in which the TPA 4 is in the final lock position. This final lock position makes inserting the terminals into the electrical connector apparatus more difficult for the operator; therefore, it is preferable that the TPA 4 is not moved to the final lock position during shipping.

Figure 3A:
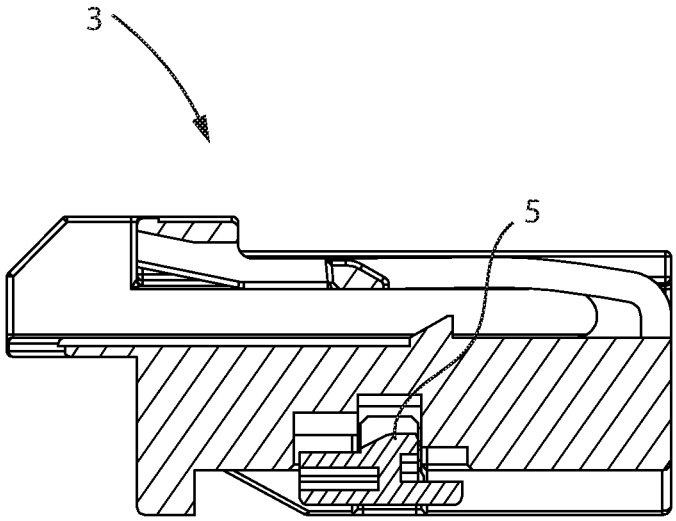
FIG. 3A is a cross-sectional view of the first embodiment of the present invention showing the female housing of the electrical connector apparatus with the TPA in the pre-set position.
Figure 3B:
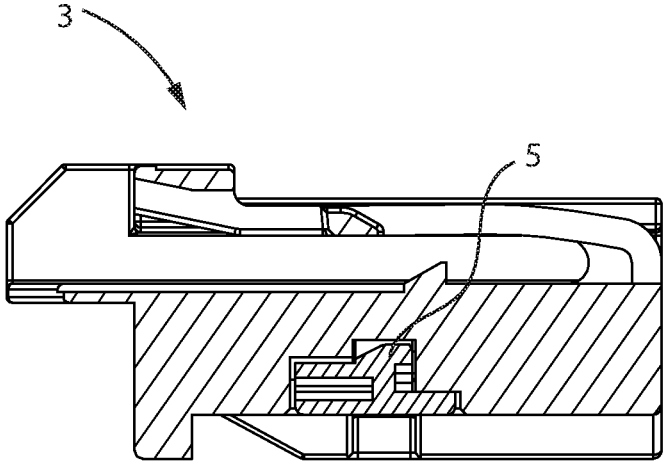
FIG. 3B is a cross-sectional view of the first embodiment of the present invention showing the female housing of the electrical connector apparatus with the TPA in the final lock position.

FIG. 3A illustrates a cross-sectional view of the female housing 3 with the TPA 5 in the pre-set position. Similar to the male housing 2, this is the position in which the female housing 3 of the electrical connector apparatus 1 is shipped. FIG. 3B shows a cross-sectional view of the female housing 3 in which the TPA 5 is in the final lock position. As explained above, it is preferable that the TPA 5 is not moved to this final lock position during shipping and/or handling.

Figure 4A:
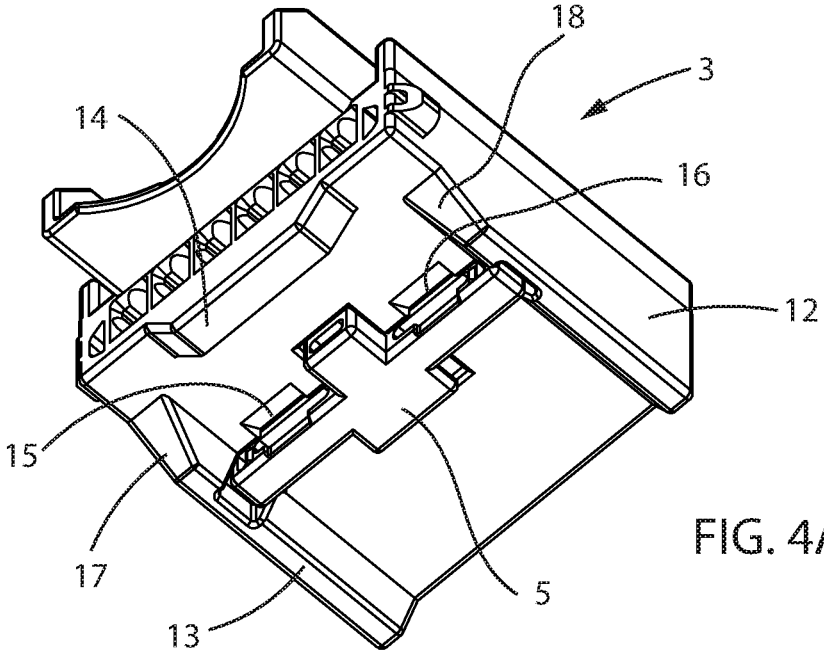
FIG. 4A is a perspective view of first embodiment of the present invention showing the female housing of the electrical connector apparatus with the TPA in the pre-set position.

FIG. 4A illustrates a perspective view of the female housing 3 of the electrical connector apparatus 1 showing the TPA 5 in the pre-set position. TPA 5 is located on the bottom, or underneath, of the female housing 3 in a bottom slot. Additionally, the female housing has a set of terminal apertures for receiving therein at least a set of terminals.

Figure 4B:
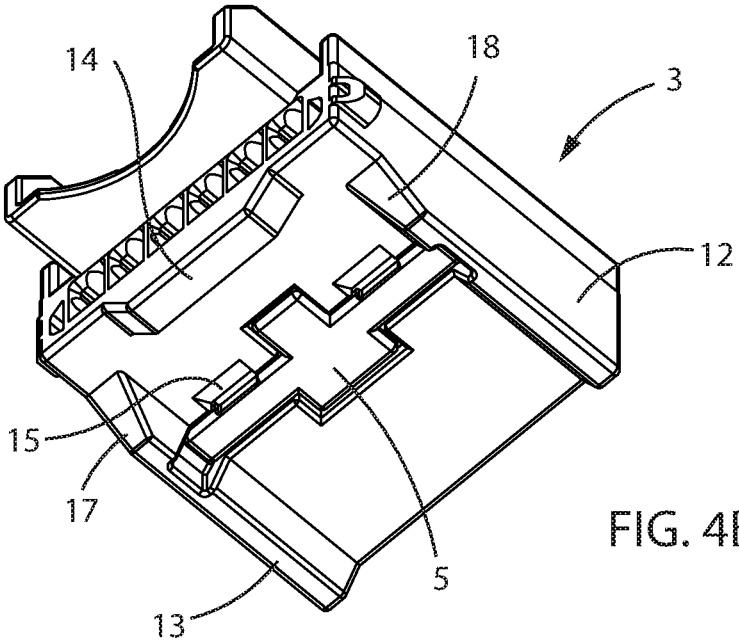
FIG. 4B is a perspective view of first embodiment of the present invention showing the female housing of the electrical connector apparatus with the TPA in the final lock position.

FIG. 4A further shows ribs 12, 13, 14, 15, 16, 17, and 18 that are provided on the bottom side of the female housing 3 and that surround the TPA 5 so as to prevent the TPA 5 from being physically pressed down into the final lock position during shipping, handling, or at any other time prior to reaching the operator. The ribs 12, 13, 14, 15, 16, 17, and 18 are located on the periphery of the TPA 5 so as to protect the TPA 5 from all sides. FIG. 4B shows the female housing 3 of the electrical connector apparatus 1 once the TPA 5 has been moved to the final lock position.

Figure 5A:
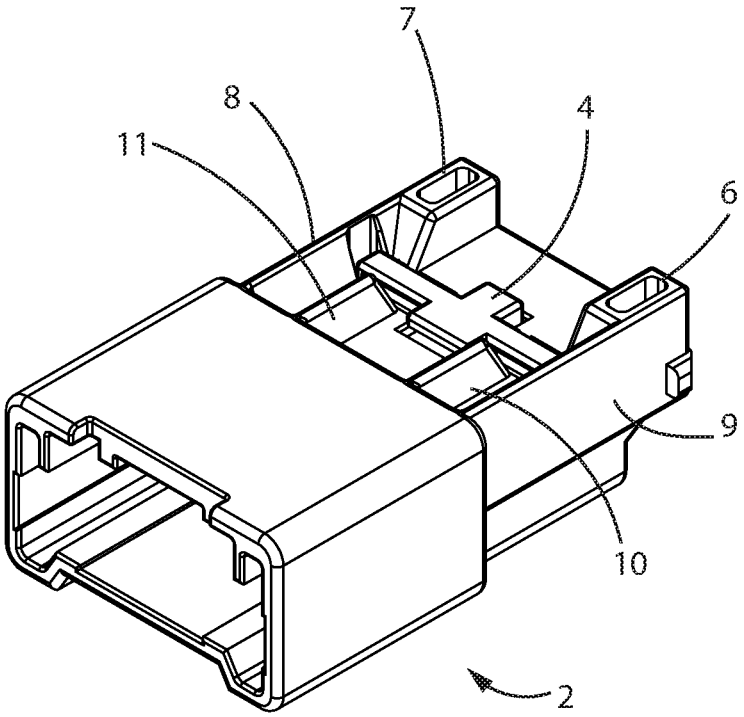
FIG. 5A is a perspective view of the first embodiment of the present invention showing the male housing of the electrical connector apparatus with the TPA in the pre-set position.
Figure 5B:
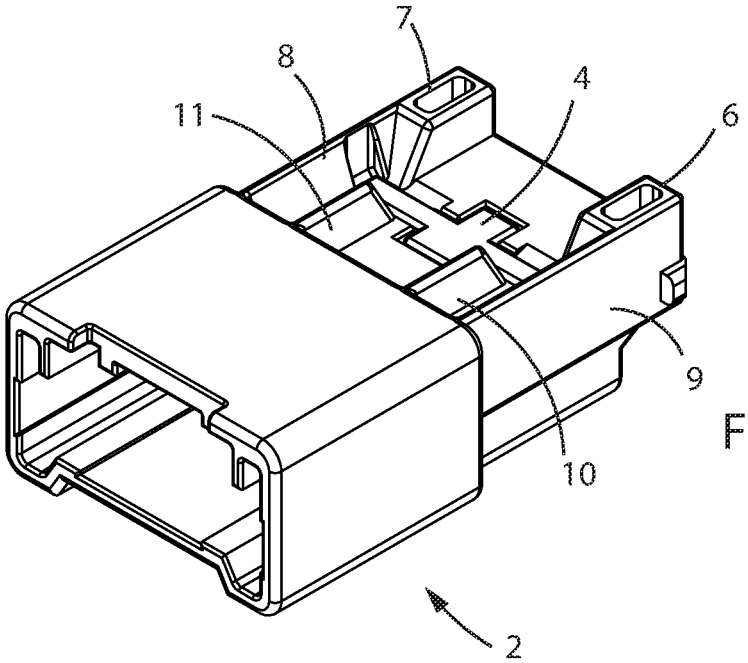
FIG. 5B is a perspective view of the first embodiment of the present invention showing the male housing of the electrical connector apparatus with the TPA in the final lock position.

FIG. 5A illustrates a perspective view of the male housing 2 of the electrical connector apparatus 1 showing the TPA 4 in the pre-set position. As can be seen in FIG. 5A, when the TPA 4 is in the pre-set position, during shipping or at any other time, the TPA 4 is protected by the ribs 6, 7, 8, 9, 10, and 11 from all sides. These ribs 6, 7, 8, 9, 10, and 11 are located on the periphery of the TPA 4 so as to protect the TPA 4 from being pressed down into the final lock position. A perspective view of the male housing with the TPA 4 pressed down into the final lock position is shown in FIG. 5B.

FIG. 6, FIG. 7, FIG. 8A, FIG. 8B, FIG. 9A, FIG. 9B, FIG. 10A, FIG. 10B, FIG. 11A and FIG. 11B illustrate an electrical connector apparatus according to the second embodiment of the present invention. Specifically, the second embodiment of the present invention includes electrical connector apparatus 100, TPA 104, and TPA 105 having 16 pins. However, the present invention is not limited to any specific number of pins for the electrical connector apparatus or TPA.

In the second embodiment of the present invention, the male housing, the female housing, the TPA, and the ribs operate identically to the first embodiment, as detailed above.

Figure 6:
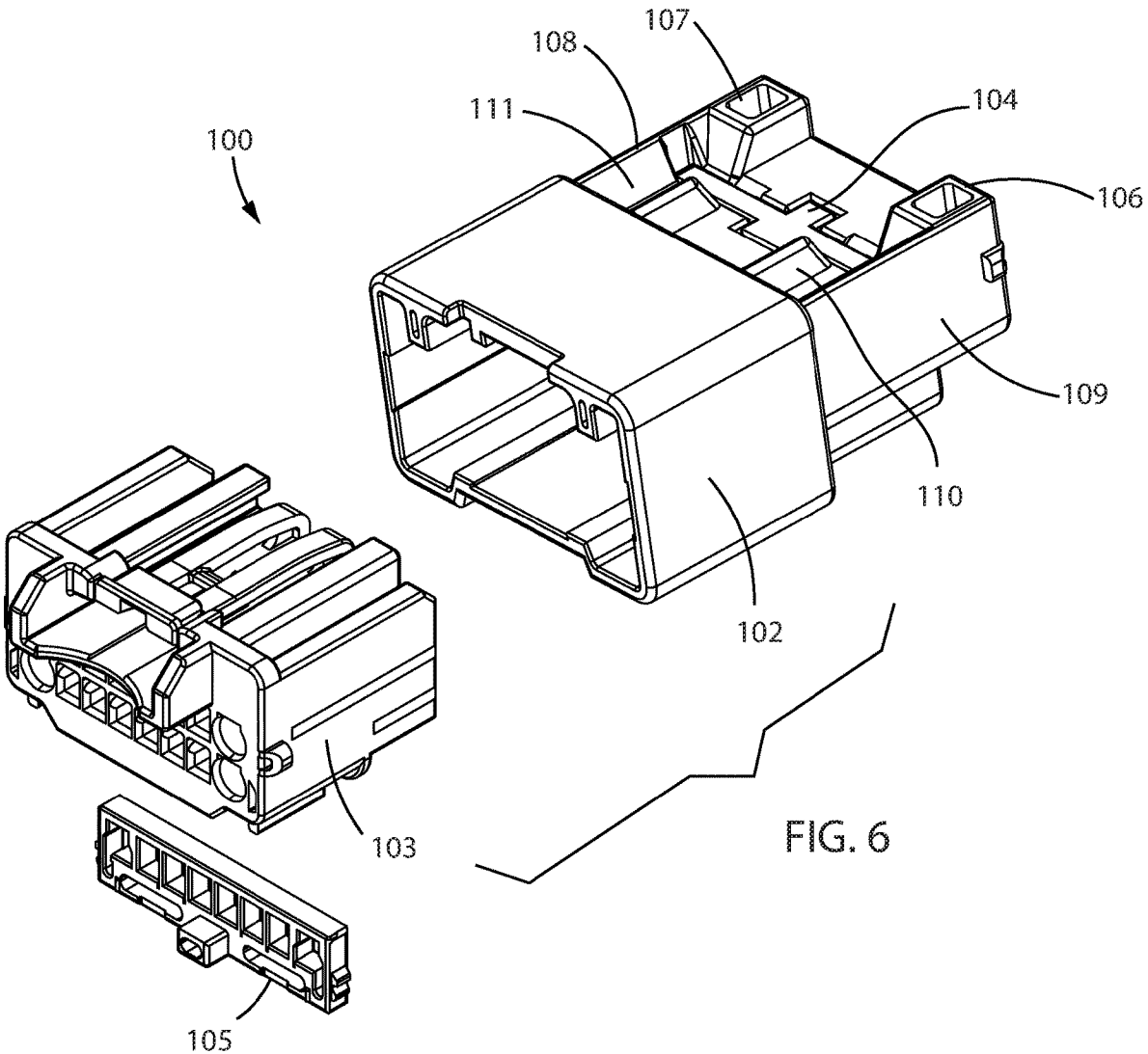
FIG. 6 is an exploded perspective view of the second embodiment of the present invention showing the electrical connector assembling including the male housing, the female housing, and the TPA.

Specifically, FIG. 6 illustrates an exploded perspective view of the electrical connector apparatus 100 according to the second embodiment of the present invention. Electrical connector apparatus 100 includes male housing 102, TPA 104, female housing 103, and TPA 105. Furthermore, FIG. 6 shows the ribs 106, 107, 108, 109, 110, and 111 provided on the male housing 102 to protect the TPA 104.

Figure 7:
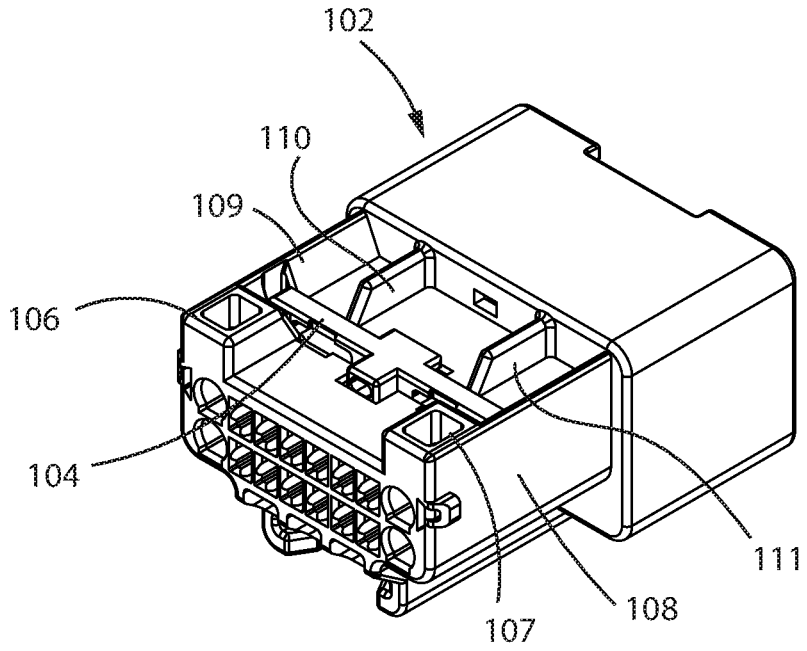
FIG. 7 is a perspective view of the second embodiment of the present invention showing the male housing of the electrical connector with the TPA in the pre-set position.

FIG. 7 is a perspective view depicting the male housing 102 of the electrical connector apparatus 100 with the TPA 104 in the pre-set position. Ribs 106, 107, 108, 109, 110, and 111 are provided on the male housing 102 so as to surround the TPA 104 along the periphery of the TPA 104. Ribs 106, 107, 108, 109, 110, and 111 protect the TPA 104 so that the TPA 104 is not moved from a pre-set position to a final lock position during shipping and/or handling.

Figure 8A:
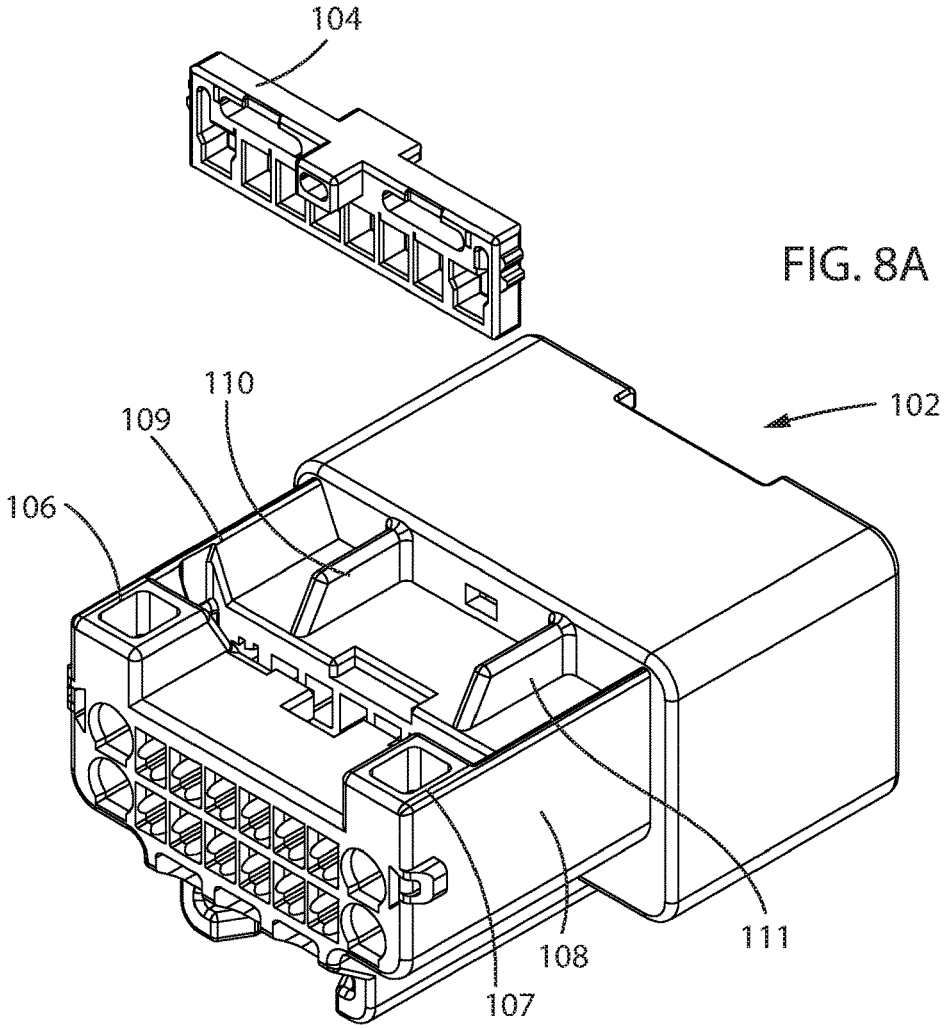
FIG. 8A is a perspective view of the second embodiment of the present invention showing the male housing and the TPA of the electrical connector apparatus.
Figure 8B:
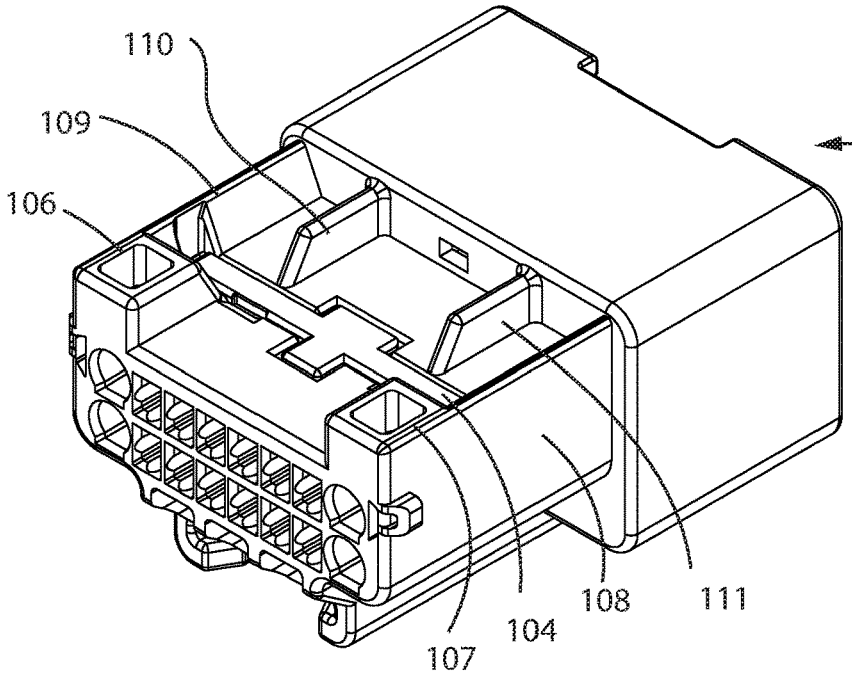
FIG. 8B is a perspective view of the second embodiment of the present invention showing the male housing of the electrical connector with the TPA in the pre-set position.

FIG. 8A illustrates a perspective view of the male housing 102 of the electrical connector apparatus 100 with the TPA 104 removed in order to fully see the placement of the TPA 104 in the male housing 102. FIG. 8B shows the male housing 102 once the TPA 104 has been inserted into the male housing 102 and set in the pre-set position.

Figure 11A:
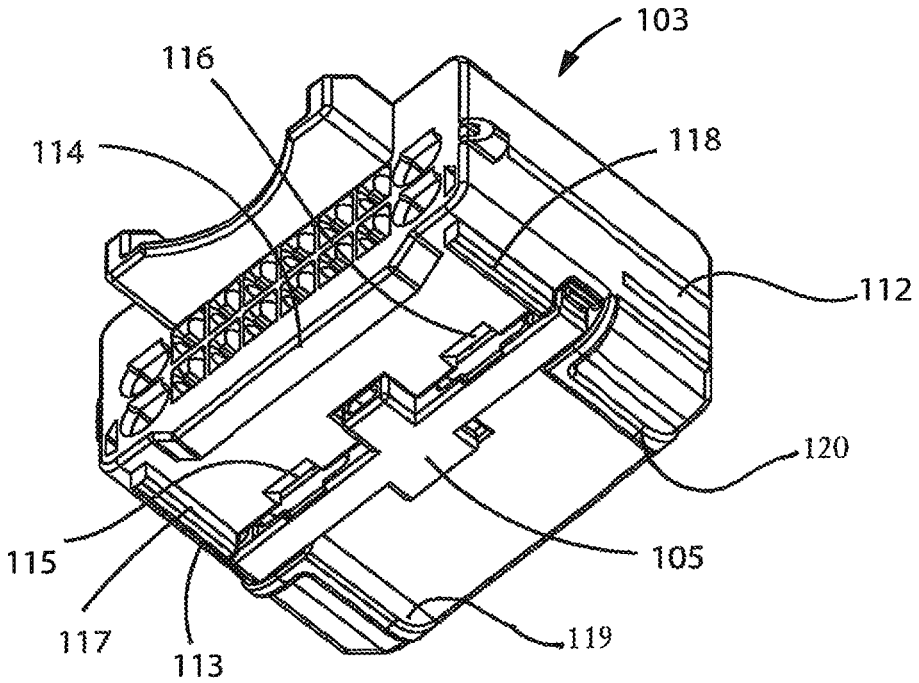
FIG. 11A is a perspective view of the second embodiment of the present invention showing the female housing of the electrical connector apparatus with the TPA in the pre-set position.
Figure 11B:
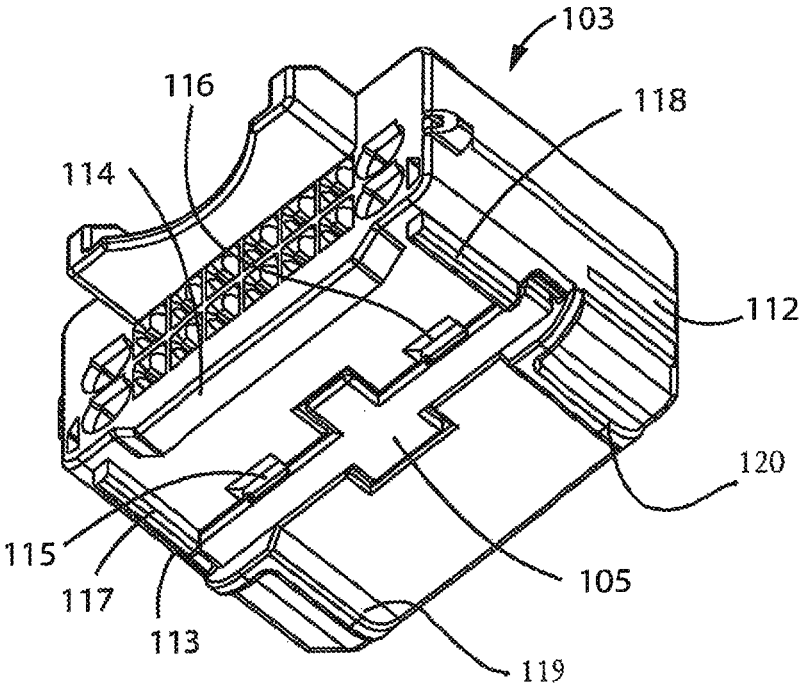
FIG. 11B is a perspective view of the second embodiment of the present invention showing the female housing of the electrical connector apparatus with the TPA in the final lock position.

The female housing 103 is also provided with ribs 112, 113, 114, 115, 116, 117, 118, 119 and 120, to protect the TPA 105 from being moved from a pre-set position, as shown in FIG. 11A, to the final lock position, as shown in FIG. 11B. These ribs 112, 113, 114, 115, 116, 117, 118, 119 and 120 are located on the periphery of the TPA 103 so as to create a physical barrier to protect the TPA 103 from all sides.

Figure 9A:
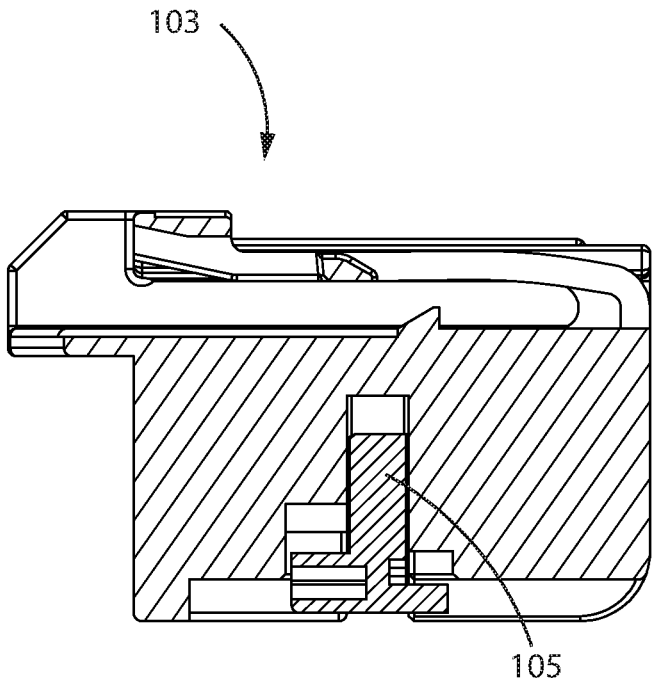
FIG. 9A is a cross-sectional view of the second embodiment of the present invention showing the female housing of the electrical connector apparatus with the TPA in the pre-set position.
Figure 9B:
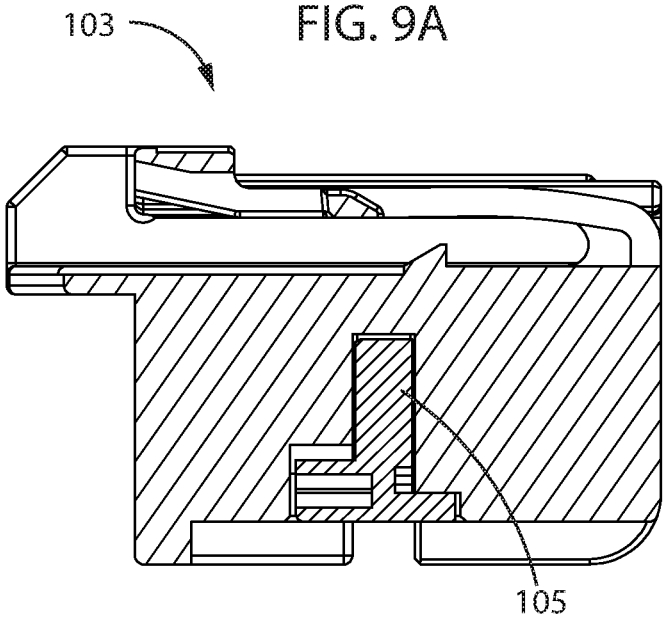
FIG. 9B is a cross-sectional view of the second embodiment of the present invention showing the female housing of the electrical connector apparatus with the TPA in the final lock position.
Figure 10A:
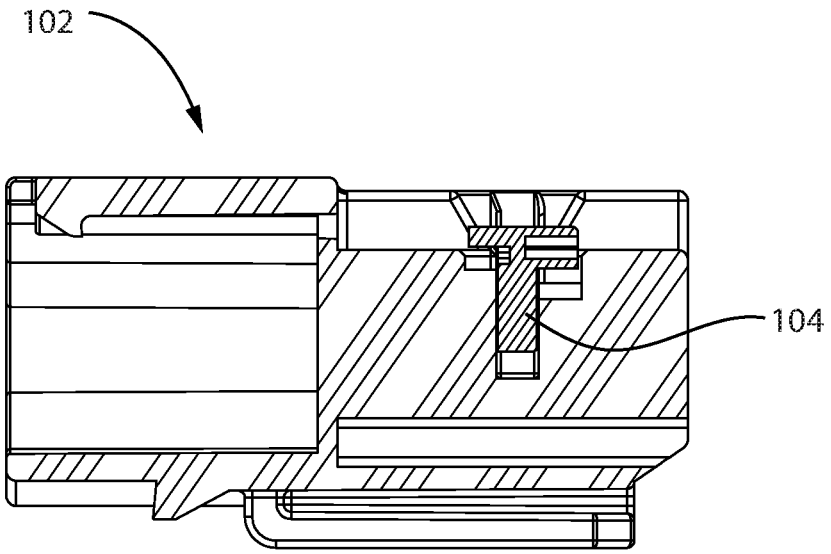
FIG. 10A is a cross-sectional view of the second embodiment of the present invention showing the male housing of the electrical connector apparatus with the TPA in the pre-set position.
Figure 10B:
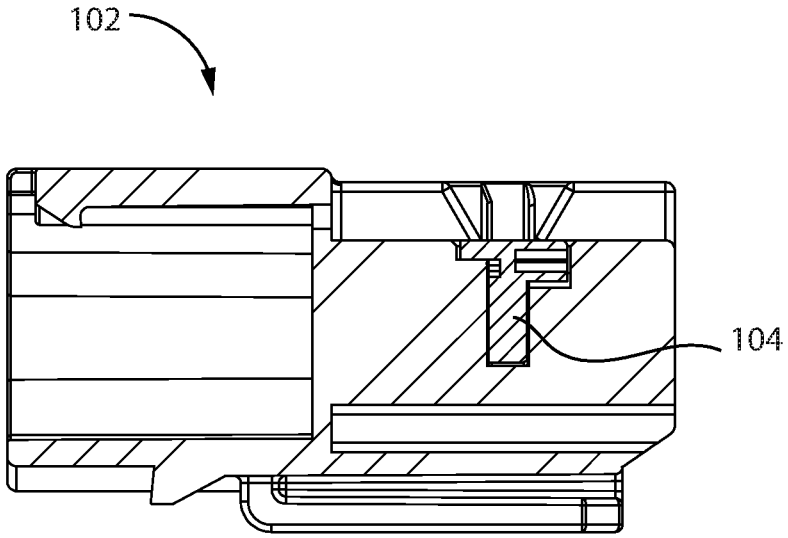
FIG. 10B is a cross-sectional view of the second embodiment of the present invention showing the male housing of the electrical connector apparatus with the TPA in the final lock position.

As can be seen in FIGS. 9A and 9B, the TPA 105 of the female housing 103 can be in either a pre-set position or a final lock position. Similarly, the TPA 104 of the male housing 102 can be in either a pre-set position, as shown in FIG. 10A, or a final lock position, as shown in FIG. 10B.

We claim:

1. An electrical connector apparatus, comprising: a female housing, comprising:

a bottom slot having two ends in a lengthwise direction located on the outer surface of a lower wall of the female housing, for accommodating a first terminal position assurance (TPA) device;

four ribs provided on the outer surface of the lower wall of the female housing, with one rib at either side of each end of the bottom slot, each rib being oriented perpendicularly to the lengthwise direction and extending away from the bottom slot;

a first terminal position assurance (TPA) device accommodated within the bottom slot; and a set of terminal apertures for receiving therein at least a set of terminals; and a male housing, comprising:

a wall having an opening having two ends in a lengthwise direction for receiving a second terminal position assurance (TPA) device;

a first rib and a second rib provided on the outer surface of said wall of the male housing on one side of said opening, each of the first and second ribs being oriented perpendicularly to the lengthwise direction and extending away from said opening; and a third rib and fourth rib provided on the outer surface of said wall of the male housing on the other side of the opening from the first and second ribs, said third and fourth ribs being located at either end of said opening and being square in shape;

a first end of the male housing having a set of apertures for accommodating therein a set of terminals; and a second end of the male housing for receiving the female housing.

2. An electrical connector apparatus according to claim 1, wherein the first TPA device in the female housing includes members for allowing the first TPA device to be at a pre-set position during transport of the female housing and at a final lock position for engaging the set of terminals.

3. An electrical connector apparatus according to claim 1, further comprising:

a second TPA device accommodated within the opening of the wall of the male housing, wherein the second TPA device in the male housing includes members for allowing the second TPA device to be at a pre-set position during transport of the male housing and at a final lock position for engaging the set of terminals.

4. A female housing, comprising:

a bottom slot having two ends in a lengthwise direction located on the outer surface of a lower wall of the female housing, for accommodating a first terminal position assurance (TPA) device;

four ribs provided on the outer surface of the lower wall of the female housing, with one rib at either side of each end of the bottom slot, each rib being oriented perpendicularly to the lengthwise direction and extending away from the bottom slot; and a first terminal position assurance (TPA) device accommodated within the bottom slot.

5. The female housing according to claim 4, wherein the first TPA device includes members extending therefrom for allowing the first TPA device to be at a pre-set position during transport of the female housing and at a final lock position for engaging a set of terminals.

6. A male housing, comprising:

a wall having an opening having two ends in a lengthwise direction for receiving a second terminal position assurance (TPA) device;

a first rib and a second rib provided on the outer surface of said wall of the male housing on one side of said opening, each of the first and second ribs being oriented perpendicularly to the lengthwise direction and extending away from said opening; and a third rib and fourth rib provided on the outer surface of said wall of the male housing on the other side of the opening from the first and second ribs, said third and fourth ribs being located at either end of said opening and being square in shape;

a first end of the male housing having a set of apertures for accommodating therein a set of terminals; and a second end of the male housing for receiving a female housing.

7. The male housing according to claim 6, further comprising:

a second TPA device accommodated within the opening of the wall, wherein the second TPA device includes members extending therefrom for allowing the second TPA device to be at a pre-set position during transport of the male housing and at a final lock position for engaging the set of terminals.

8. The male housing according to claim 7, wherein when the second TPA device is in a final lock position, a female housing can be inserted and accommodated within the second end of the male housing.

9. The male housing according to claim 7, wherein:

each of the first, second, third and fourth ribs extends further out from said wall than the second TPA device extends from said wall when the second TPA device is in the pre-set position.

10. A method for assembling an electrical connector apparatus, comprising the steps of:

providing a female housing comprising:

a set of terminal apertures for receiving therein at least a set of terminals;

a bottom slot having two ends in a lengthwise direction located on the outer surface of a lower wall of the female housing, for accommodating a first terminal position assurance (TPA) device; and four ribs provided on the outer surface of the lower wall of the female housing, with one rib at either side of each end of the bottom slot, each rib being oriented perpendicularly to the lengthwise direction and extending away from the bottom slot;

accommodating a first terminal position assurance (TPA) device within the bottom slot of the female housing;

providing a male housing comprising:

a set of terminal apertures for receiving therein a set of other terminals;

a wall having an opening having two ends in a lengthwise direction for receiving a second terminal position assurance (TPA) device;

a first rib and a second rib provided on the outer surface of said wall of the male housing on one side of said opening, each of the first and second ribs being oriented perpendicularly to the lengthwise direction and extending away from said opening; and a third rib and fourth rib provided on the outer surface of said wall of the male housing on the other side of the opening from the first and second ribs, said third and fourth ribs being located at either end of said opening and being square in shape;

accommodating a second terminal position assurance (TPA) device within an opening of the male housing; and accommodating the female housing into the male housing.

11. The method for assembling the electrical connector apparatus according to claim 10, wherein the step of accommodating the first TPA device within the bottom slot of the female housing further comprises the step of providing the first TPA device with members extending therefrom for allowing the first TPA device to be at a pre-set position during transport of the female housing and to be at a final lock position for engaging the set of terminals.

12. The method for assembling the electrical connector apparatus according to claim 10, wherein the step of accommodating the second TPA device within the opening of the male housing further comprises the step of providing members extending from the second TPA device for allowing the second TPA device to be at a pre-set position during transport of the male housing and at a final lock position for engaging the set of terminals.

* * * * *